US009046829B2

(12) United States Patent
Miura

(10) Patent No.: US 9,046,829 B2
(45) Date of Patent: Jun. 2, 2015

(54) IMAGE FORMATION APPARATUS THAT ADJUSTS DENSITY OF CURRENT FLOWING THROUGH A RECORDING MEDIUM

(71) Applicant: Oki Data Corporation, Tokyo (JP)

(72) Inventor: Hiroshi Miura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/088,469

(22) Filed: Nov. 25, 2013

(65) Prior Publication Data

US 2014/0147137 A1 May 29, 2014

(30) Foreign Application Priority Data

Nov. 28, 2012 (JP) ..... 2012-259935

(51) Int. Cl.
*G03G 15/00* (2006.01)
*G03G 15/16* (2006.01)

(52) U.S. Cl.
CPC .. *G03G 15/1675* (2013.01); *G03G 2215/00734* (2013.01); *G03G 2215/00751* (2013.01); *G03G 2215/0129* (2013.01)

(58) Field of Classification Search
USPC ..... 399/66, 45
See application file for complete search history.

(56) References Cited

U.S. PATENT DOCUMENTS 5,999,760 A * 12/1999 Suzuki et al. ..... 399/45
6,175,716 B1 * 1/2001 Toyama et al. ..... 399/384
6,996,349 B2 * 2/2006 Ohta et al. ..... 399/45
2003/0185581 A1 * 10/2003 Hisada ..... 399/45
2010/0067936 A1 * 3/2010 Kitajima ..... 399/72
2011/0069979 A1 * 3/2011 Yamada ..... 399/44
2012/0045237 A1 * 2/2012 Aoki et al. ..... 399/66
2012/0177391 A1 * 7/2012 Lee et al. ..... 399/66

FOREIGN PATENT DOCUMENTS

JP 2000-075687 A 3/2000
JP 2000-181242 A 6/2000
JP 2002-014551 A 1/2002
JP 2006-071954 A 3/2006
JP 2008-242026 A 10/2008
JP 2009-251125 A 10/2009

* cited by examiner

*Primary Examiner* — Billy Lactaoen
*Assistant Examiner* — Arlene Heredia Ocasio
(74) *Attorney, Agent, or Firm* — Marvin A. Motsenbocker; Mots Law, PLLC

(57) ABSTRACT

An image formation apparatus includes a primary transfer unit configured to transfer a developer image from an image carrier to an intermediate transfer body, a secondary transfer unit configured to transfer the developer image to a recording medium, a voltage application unit configured to apply a voltage to the secondary transfer unit, a voltage controller configured to control the voltage to be applied to the secondary transfer unit by the voltage application unit, a recording medium type detector configured to detect a type of the recording medium, and a recording medium width detector configured to detect a width of the recording medium in a direction orthogonal to a conveyance direction of the intermediate transfer body. The voltage controller controls the voltage to be applied to the secondary transfer unit, based on the detected recording medium type and the detected recording medium width.

10 Claims, 18 Drawing Sheets

FIG.5

63

| TYPE OF RECORDING MEDIUM | SECONDARY-TRANSFER CURRENT MEASUREMENT VOLTAGE Vm | | |
|---|---|---|---|
| HIGH-QUALITY PAPER | Vm1 | Vm2 | |
| PLAIN PAPER | Vm1 | Vm3 | |
| OHP FILM | Vm1 | Vm4 | Vm5 |

FIG.6

| TYPE OF RECORDING MEDIUM | SECONDARY-TRAN CURRENT Im [μA] | | |
|---|---|---|---|
| HIGH-QUALITY PAPER | Im1 | Im2 | |
| PLAIN PAPER | Im1 | Im3 | |
| OHP FILM | Im1 | Im4 | Im5 |

64

FIG.8

| TYPE OF RECORDING MEDIUM | SECONDARY-TRANSFER BASIC CURRENT DENSITY Jb [μA/mm] | SECONDARY-TRANSFER BASIC VOLTAGE Vb [V] |
|---|---|---|
| HIGH-QUALITY PAPER | Jb1 | Vb1 |
| PLAIN PAPER | Jb2 | Vb2 |
| OHP FILM | Jb3 | Vb3 |

65

FIG.12

| TYPE OF RECORDING MEDIUM | SECONDARY-TRANSFER CURRENT MEASUREMENT VOLTAGE Vm [V] | | |
|---|---|---|---|
| HIGH-QUALITY PAPER | 1000 | 3000 | |
| PLAIN PAPER | 1000 | 4000 | |
| OHP FILM | 1000 | 5000 | 10000 |

66

FIG.13

| TYPE OF RECORDING MEDIUM | SECONDARY-TRANSFER CURRENT Im [μA] | | |
|---|---|---|---|
| HIGH-QUALITY PAPER | 10 | 65 | |
| PLAIN PAPER | 10 | 98 | |
| OHP FILM | 10 | 130 | 350 |

67

FIG.14

| TYPE OF RECORDING MEDIUM | SECONDARY-TRANSFER BASIC CURRENT DENSITY Jb [μA/mm] | SECONDARY-TRANSFER BASIC VOLTAGE Vb [V] |
|---|---|---|
| HIGH-QUALITY PAPER | 0.100 | 500 |
| PLAIN PAPER | 0.105 | 800 |
| OHP FILM | 0.110 | 1800 |

68

FIG.15

| TYPE OF RECORDING MEDIUM | WIDTH OF RECORDING MEDIUM | | |
|---|---|---|---|
| | 297mm(A3) | 210mm(A4) | 148mm(A5) |
| HIGH-QUALITY PAPER | 2344[V] | 2510[V] | 2628[V] |
| PLAIN PAPER | 2686[V] | 2995[V] | 3215[V] |
| OHP FILM | 4059[V] | 5643[V] | 6772[V] |

IMAGE FORMATION APPARATUS THAT ADJUSTS DENSITY OF CURRENT FLOWING THROUGH A RECORDING MEDIUM

CROSS REFERENCE TO RELATED APPLICATIONS

This application claims priority based on 35 USC 119 from prior Japanese Patent Application No. 2012-259935 filed on Nov. 28, 2012, entitled "IMAGE FORMATION APPARATUS", the entire contents of which are incorporated herein by reference.

BACKGROUND OF THE INVENTION

Field of the Invention

This disclosure relates to an image formation apparatus which forms an image on a recording medium by using an electrophotographic method.

A conventional image formation apparatus employs a direct transfer method in which a toner image is directly transferred from an electrostatic latent image carrier to a recording medium. In an image formation apparatus of a tandem configuration, four process units each configured with a photosensitive body, a charge unit, an exposure unit, a development unit, and the like are arranged side by side as image formation units for black, yellow, magenta, and cyan colors, respectively, and sequentially transfer toner images on a recording medium. In such a tandem image formation apparatus, in order to obtain a favorable print quality irrespective of the type of a recording medium, transfer conditions are controlled based on a resistance value of the recording medium (see, for example, Patent Document 1: Japanese Patent Application Publication No. 2008-242026).

SUMMARY OF THE INVENTION

In an image formation apparatus of an intermediate transfer type, on the other hand, a toner image is transferred to an intermediate transfer body, such as an intermediate transfer belt, and is then transferred therefrom to a recording medium. In such an image formation apparatus, compared to an image formation apparatus employing the direct transfer method, transfer current that flows in transferring a toner image to a recording medium highly depends on the width of the recording medium measured in a direction orthogonal to the conveyance direction of the intermediate transfer belt. Thus, with the conventional technique where quality depends on width, a favorable print quality cannot be obtained in some cases.

An embodiment of the invention has an objective of obtaining a favorable print quality irrespective of the width of a recording medium.

An aspect of the invention is an image formation apparatus that includes: a primary transfer unit configured to transfer a developer image formed on an image carrier to an intermediate transfer body; a secondary transfer unit configured to transfer the developer image transferred to the intermediate transfer body to a recording medium; a voltage application unit configured to apply a voltage to the secondary transfer unit; a voltage controller configured to control the voltage to be applied to the secondary transfer unit by the voltage application unit; a recording medium type detector configured to detect a type of the recording medium; and a recording medium width detector configured to detect a width of the recording medium measured in a direction orthogonal to the conveyance direction of the intermediate transfer body. The voltage controller controls the voltage to be applied to the secondary transfer unit, based on the type of the recording medium detected by the recording medium type detector and the width of the recording medium detected by the recording medium width detector.

The above aspect of the invention can obtain a favorable print quality irrespective of the width of a recording medium, by controlling the secondary-transfer voltage.

BRIEF DESCRIPTION OF THE DRAWINGS

FIG. 5 is a data table of secondary-transfer current measurement voltage in the first embodiment.

FIG. 6 is a data table of secondary-transfer current in the first embodiment.

FIG. 8 is a data table illustrating relations between secondary-transfer basic current densities and secondary-transfer basic voltages to be applied to achieve the corresponding secondary-transfer basic current densities.

FIG. 12 is a data table of secondary-transfer current measurement voltages in the first embodiment (an example using numeral values).

FIG. 13 is a data table of secondary-transfer currents in the first embodiment (an example using numeral values).

FIG. 14 is a data table illustrating relations between secondary-transfer basic current densities and secondary-transfer basic voltages to be applied to achieve the corresponding secondary-transfer basic current densities (an example using numeral values).

FIG. 15 is a data table of secondary-transfer voltages calculated by the image formation apparatus in the first embodiment (an example using numerical values).

DETAILED DESCRIPTION OF EMBODIMENTS

Figure 1:
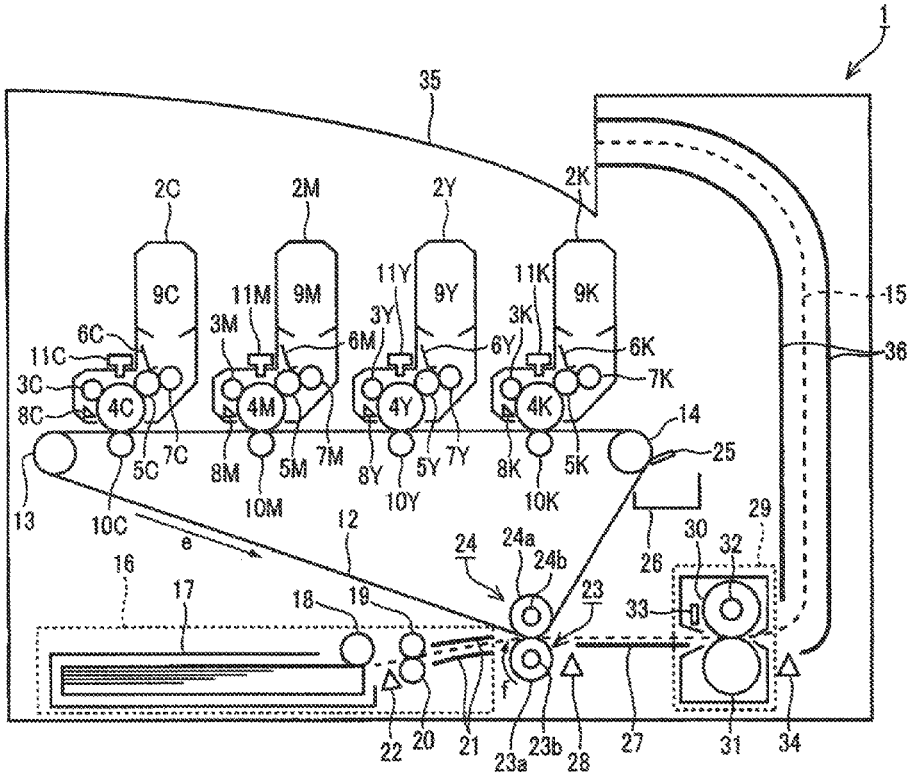
FIG. 1 is a diagram illustrating the configuration of an image formation apparatus in a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of an image formation apparatus according to the invention are described below with reference to the drawings.

Embodiment 1

FIG. 1 is a diagram illustrating the configuration of an image formation apparatus of a first embodiment. In FIG. 1, printer 1 is an electrophotographic image formation apparatus capable of printing toner images on a sheet (recording medium) based on print data transmitted from a host computer. Printer 1 is configured with: print mechanisms 2K, 2Y, 2M, and 2C configured to form and transfer toner images; light emitting diode (LED) heads 11K, 11Y, 11M, and 11C incorporated in the respective print mechanisms; intermediate transfer belt 12 to which the toner images are transferred by the print mechanisms; driving roller 13 configured to convey intermediate transfer belt 12; driven roller 14 configured to be driven by intermediate transfer belt 12; secondary-transfer roller 23 and secondary-transfer opposed roller 24 which are configured to perform secondary transfer on a sheet; sheet-feed mechanism 16 configured to feed a sheet; secondary-transfer discharge sensor 28 configured to monitor, for example, wrapping of a sheet around secondary-transfer roller 23; cleaning blade 25 configured to remove toner remaining on intermediate transfer belt 12 after secondary transfer (secondary-transfer residual toner); waste toner tank 26 configured to collect the secondary-transfer residual toner scraped by the cleaning blade 25; fixation mechanism 29 configured to fix the toner images transferred to the sheet; fixation discharge sensor 34 configured to monitor, for example, paper jam at fixation mechanism 29; guides 27 and 36 configured to guide the sheet in its conveyance direction; and stacker 35 configured to receive a printed sheet thereon.

In printer 1, four independent print mechanisms (process units) 2K, 2Y, 2M, and 2C corresponding to four colors (black K, yellow Y, magenta M, and cyan C), respectively, are arranged along the conveyance direction of intermediate transfer belt 12. Print mechanism 2K forms a black toner image, print mechanism 2Y forms a yellow toner image, print mechanism 2M forms a magenta toner image, and print mechanism 2C forms a cyan toner image. Print mechanisms 2K, 2Y, 2M, and 2C include, respectively: charge rollers 3K, 3Y, 3M, and 3C; photosensitive drums 4K, 4Y, 4M, and 4C charged at their surfaces uniformly by charge rollers 3K, 3Y, 3M, and 3C; development parts which include development rollers 5K, 5Y, 5M, and 5C; development blades 6K, 6Y, 6M, and 6C; and supply rollers 7K, 7Y, 7M, and 7C, and are configured to form toner images. The print mechanism further includes, respectively: neutralization light sources 8K, 8Y, 8M, and 8C configured to neutralize the surfaces of photosensitive drums 4K, 4Y, 4M, and 4C; and toner cartridges 9K, 9Y, 9M, and 9C configured to supply toner (developer) to the development parts, and the like.

LED heads 11K, 11Y, 11M, and 11C cause the LED arrays to emit light in accordance with image data signals to be described later. As color image data signals, a black image data signal is inputted to LED head 11K, and similarly, a yellow image data signal, a magenta image data signal, and a cyan image data signal are inputted to LED head 11Y, 11M, and 11C, respectively. LED heads 11K, 11Y, 11M, and 11C irradiate the surfaces of photosensitive drums 4K, 4Y, 4M, and 4C with light based on the inputted image data signals and form electrostatic latent images.

Intermediate transfer belt 12 is formed of a highly-resistive plastic film formed into an endless, seamless belt, and is looped around driving roller 13, driven roller 14, and secondary-transfer opposed roller 24 with a predetermined tension. Driving roller 13 is rotated by belt motor 46, conveying the intermediate transfer belt 12 in a direction indicated by arrow e in FIG. 1. Driven roller 14 and secondary-transfer opposed roller 24 are driven by intermediate transfer belt 12.

Intermediate transfer belt 12 is pushed against photosensitive drums 4K, 4Y, 4M, and 4C by primary-transfer rollers 10K, 10Y, 10M, and 10C. First-transfer rollers 10K, 10Y, 10M, and 10C form primary-transfer nip portions by being in contact with photosensitive drums 4K, 4Y, 4M, and 4 with intermediate transfer belt 12 interposed therebetween. Predetermined DC voltages are applied to primary-transfer rollers 10K, 10Y, 10M, and 10C by primary-transfer voltage generator 54, and operates to transfer toner images on photosensitive drums 4K, 4Y, 4M, and 4C to intermediate transfer belt 12.

Sheet-feed mechanism 16 is provided at a lower part of printer 1 to feed a sheet to conveyance route 15 (shown with a dotted line in FIG. 1). Sheet-feed mechanism 16 includes sheet-housing cassette 17, a hopping roller 18 configured to pick up and send a sheet (recording medium) housed in sheet housing cassette 17, pinch roller 19 configured to correct a skew of the sheet, registration roller 20 configured to send the sheet to the secondary-transfer roller 23, guides 21 configured to guide the sheet to the secondary-transfer roller 23, and sheet-feed sensor 22 configured to detect an arrival of the sheet at a position between the pinch roller 19 and registration roller 20.

Second-transfer roller 23 includes metal shaft 23*b* and conductive urethane foam 23*a* having a volume resistivity of about $10^7$ Ω·cm to $10^9$ Ω·cm or the like. Secondary-transfer opposed roller 24 includes metal shaft 24*b* and metal roller 24*a*. Second-transfer roller 23 is placed opposite secondary-transfer opposed roller 24 with intermediate transfer belt 12 therebetween.

Metal shaft 23*b* of secondary-transfer roller 23 is connected to secondary-transfer voltage generator 55 via fixed resistance 56 so that a transfer failure may not occur due to fluctuation in a resistance value of secondary-transfer roller in a circumferential direction. Metal shaft 24*b* of secondary-transfer opposed roller 24 is connected to ground. Metal shaft 24*b* and metal roller 24*a* of secondary-transfer opposed roller 24 are at the same potential. Second-transfer roller 23 is rotated by secondary-transfer motor 48 in a direction indicated by arrow f in FIG. 1. Intermediate transfer belt 12 is pushed against secondary-transfer opposed roller 24 by secondary-transfer roller 23. Secondary-transfer roller 23 forms a secondary-transfer nip portion by being in contact with secondary-transfer opposed roller 24, with intermediate transfer belt 12 interposed in between.

A predetermined DC current is applied to secondary-transfer roller 23 by secondary-transfer voltage generator 55, to transfer toner images on intermediate transfer belt 12 to a sheet. The sheet past the secondary-transfer roller 23 is separated from intermediate transfer belt 12 and is conveyed to guide 27 which guides the sheet to fixation mechanism 29. Second-transfer discharge sensor 28 is provided at the downstream of secondary-transfer roller 23 in the sheet conveyance direction and monitors a wrapping of the sheet around secondary-transfer roller 23 and any failure of separation of the sheet from intermediate transfer belt 12. Fixation mechanism 29 includes heat roller 30, pressure roller 31 configured to apply pressure to heat roller 30, and the like.

Heat roller 30 is driven by heat motor 49, and pressure roller 31 is driven by heat roller 30. Heat roller 30 is equipped with, as a heat source, heater 32 formed of a halogen lamp. Thermistor 33 is placed near the surface of heat roller 30 to monitor the temperature of heat roller 30. Fixation mechanism 29 is configured to fix the toner images to the sheet by heating and melting the toner on the sheet.

Fixation discharge sensor 34 is provided at the downstream of fixation mechanism 29 and monitors for any paper jam at fixation mechanism 29 and the wrapping of the sheet around heat roller 30. Guides 36 are provided at the downstream of fixation discharge sensor 34 in the sheet conveyance direction to convey the sheet to stacker 35 provided at an upper portion of a casing of printer 1, and the printed sheet is discharged to stacker 35.

Cleaning blade 25 is placed opposite driven roller 14 at a position downstream of secondary-transfer roller 23 in the conveyance direction of intermediate transfer belt 12. Cleaning blade 25 removes toner which has not transferred to the sheet in the secondary transfer but remains on intermediate transfer belt 12 (secondary-transfer residual toner). Cleaning blade 25 is made of a flexible rubber or plastic material and scrapes off the secondary-transfer residual toner on intermediate transfer belt 12 to waste toner tank 26.

Figure 2:
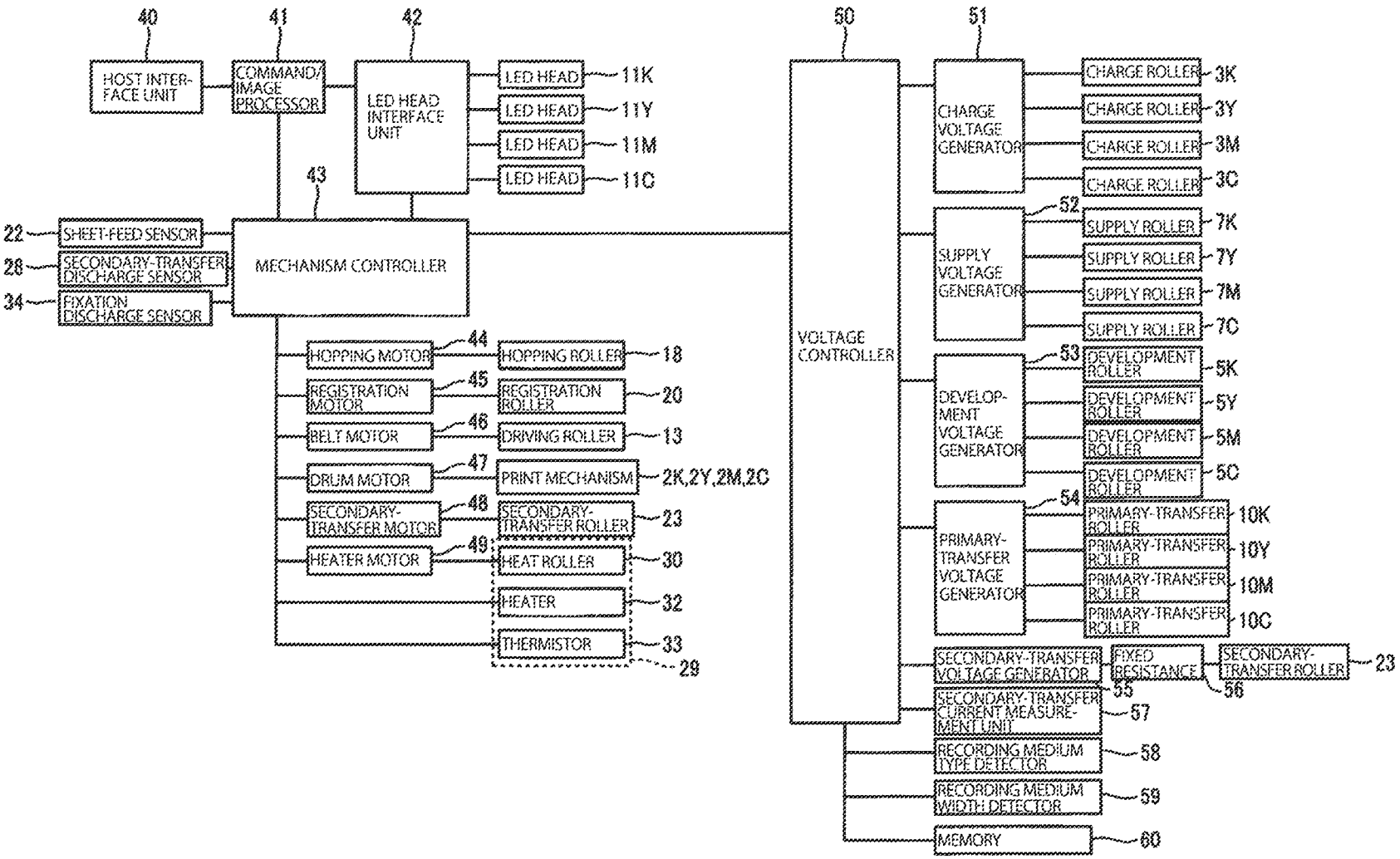
FIG. 2 is a block diagram of a control circuit of the image formation apparatus in the first embodiment (employing a fixed-voltage control method).

Next, the configuration of a control circuit of this embodiment is described. FIG. 2 is a block diagram of a control circuit of the image formation apparatus of the first embodiment (employing a constant-voltage control method). In FIG. 2, host interface unit 40 is configured to function as a physical-layer interface between printer 1 and the host computer. Command/image processor 41 is configured to interpret commands and image data from the host computer or convert them into the bitmap format. Command/image processor 41 performs overall control of printer 1. In this embodiment, image data refers to data contained in print data transmitted from the host computer, which is converted into bitmap image data by command/image processor 41.

LED head interface unit 42 is configured to process the bitmap image data from command/image processing part 41 to suit the data to the interfaces to LED heads 11K, 11Y, 11M, and 11C. In this embodiment, image data signals are data obtained by LED head interface unit 42 by processing the bitmap image data obtained by command/image processor 41 to suit the data to the respective colors of the LED heads.

Mechanism controller 43 is a mechanism part configured to control each part of an engine unit of printer 1. Specifically, in accordance with commands from command/image processor 41, mechanism controller 43 controls the driving of hopping motor 44, registration motor 45, belt motor 46, drum motor 47, secondary-transfer motor 48, and heater motor 49 based on signals from sheet-feed sensor 22, secondary-transfer discharge sensor 28, and fixation discharge sensor 34. Mechanism controller 43 further controls the temperature of heater 32 based on a signal from thermistor 33, and controls outputting of voltages to voltage controller 50.

Voltage controller 50 is configured to control charge voltage generator 51, supply voltage generator 52, development voltage generator 53, primary-transfer voltage generator 54, and secondary-transfer current measurement unit 57 according to commands from mechanism controller 43. In addition, voltage controller 50 is configured to control the secondary-transfer voltage generator based on a result of a detection made by recording medium type detector 58 and recording medium width detector 59. Charge voltage generator 51 is configured to generate and stop charge voltages applied to charge rollers 3K, 3Y, 3M, and 3C according to a command from voltage controller 50.

Supply voltage generator 52 is configured to generate and stop supply voltages applied to supply rollers 7K, 7Y, 7M, and 7C according to a command from voltage controller 50. Development voltage generator 53 is configured to generate and stop development voltages applied to development rollers 5K, 5Y, 5M, and 5C according to a command from voltage controller 50. First-transfer voltage generator 54 is configured to generate and stop primary-transfer voltages applied to primary-transfer rollers 10K, 10Y, 10M, and 10C according to a command from voltage controller 50.

Second-transfer voltage generator 55 is configured to generate and stop a secondary-transfer voltage to secondary-transfer roller 23 via fixed resistance 56 according to a command from voltage controller 50. Second-transfer current measurement unit 57 is configured to measure secondary-transfer current flowing through secondary-transfer roller 23, according to a command from voltage controller 50. Recording medium type detector 58 is configured to detect the type of a recording medium used for printing, based on recording-medium setting information contained in the print data sent from the host computer.

Recording medium width detector 59 is configured to detect the width of a recording medium used for printing, based on the recording-medium setting information contained in the print data sent from the host computer. Stored in memory 60 are setting values for charge voltage generator 51, supply voltage generator 52, development voltage generator 53, primary-transfer voltage generator 54, and secondary-transfer voltage generator 55. In printer 1 thus configured, the control circuit illustrated in FIG. 2 is configured with a control unit such as a central processing unit (CPU), and controls the overall operation of printer 1 based on control programs (software) stored in a storage unit such as a memory.

Figure 3:
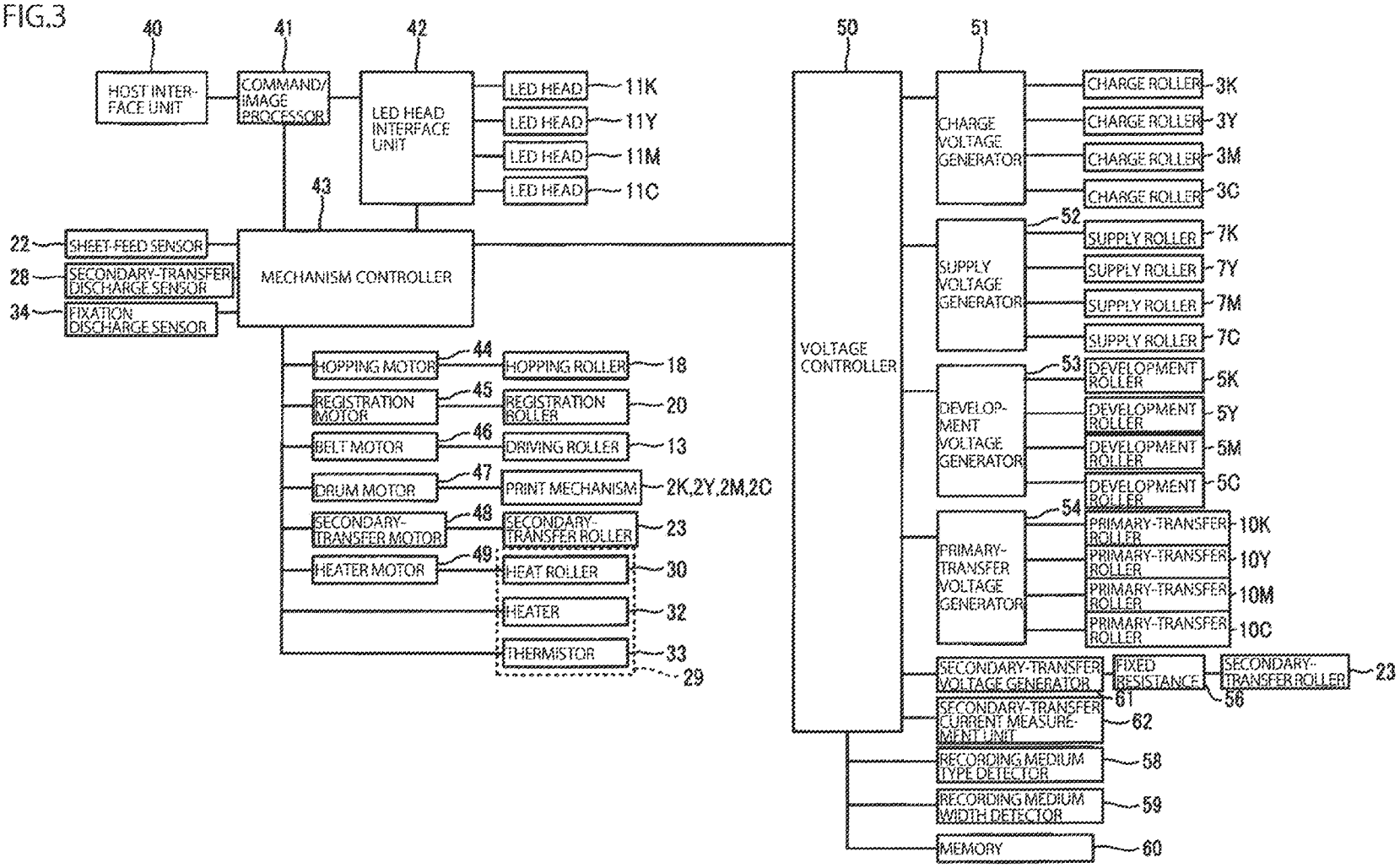
FIG. 3 is a block diagram of a control circuit of the image formation apparatus in the first embodiment (employing a fixed-current control method).

Although the configuration described in this embodiment employs a constant-voltage control method in the secondary-transfer, a constant-current control method illustrated in FIG. 3 may be employed instead. The configuration in FIG. 3 is different from that of this embodiment in that secondary-transfer voltage generator 55 is changed to a secondary-transfer current generator 61 and that secondary-transfer current measurement unit 57 is changed to a secondary-transfer voltage measurement unit 62. Operation of printer 1 having the above configuration is next described.

In FIG. 2, once host interface unit 40 receives print data sent from the host computer, command/image processor 41 gives mechanism controller 43 a command to start warming up fixation mechanism 29, and also generates, on a page basis, bitmap data for each color by converting the image data. Upon receipt of the command to start the warm-up from command/image processor 41, mechanism controller 43 adjusts a fixation temperature by controlling heat motor 49 and thereby driving heat roller 30, and controlling on and off of heater 32 by reference to a signal from thermistor 33.

Once the fixation temperature reaches a preset temperature at which toner images on the recording medium can be fixed, mechanism controller 43 starts the printing operation. Mechanism controller 43 controls belt motor 46, drum motor 47, and secondary-transfer motor 48 to drive driving roller 13, the rollers of print mechanisms 2K, 2Y, 2M, and 2C, and secondary-transfer roller 23. Upon receipt of a voltage output command from mechanism controller 43, voltage controller 50 reads the set values of a charge voltage, a supply voltage, and a development voltage stored in memory 60, and causes charge voltage generator 51, supply voltage generator 52, and development voltage generator 53 to supply bias voltages to the rollers of print mechanisms 2K, 2Y, 2M, and 2C.

Next, a description is given of how print mechanisms 2K, 2Y, 2M, and 2C form toner images. Here, black print mechanism 2K is described as a representative example, and yellow, magenta, and cyan print mechanisms 2Y, 2M, and 2C which are the same as black print mechanism 2K are not described. In FIGS. 1 and 2, once the bias voltages are supplied by charge voltage generator 51, supply voltage generator 52, and development voltage generator 53, charge roller 3K is supplied with a charge voltage of −1100V, charging the surface of photosensitive drum 4K to −600V. In addition, development roller 5K is supplied with a development voltage of −200V, and supply roller 7K is supplied with a supply voltage of −250V, forming, near the nip area between development roller 5K and supply roller 7K, an electric field directed from development roller 5K to supply roller 7K.

Black toner is housed in toner cartridge 9K of print mechanism 2K. The toner supplied from toner cartridge 9K is strongly rubbed by development roller 5K and supply roller 7K and is thereby charged by friction. In this embodiment, toner is negatively charged by friction due to the characteristics of development rollers 5K, 5Y, 5M, and 5C and supply rollers 7K, 7Y, 7M, and 7C. The toner negatively charged by friction is attached to development roller 5K by a coulomb force of the electric field directed from development roller 5K to supply roller 7K.

The attached toner is carried to a contact portion between development roller 5K and development blade 6K by a counterclockwise rotation (as seen in FIG. 1) of development roller 5K, and is averaged by development blade 6K into an even thickness to form a toner layer. Development roller 5K keeps rotating counterclockwise in FIG. 1, carrying the toner layer to a nip portion between development roller 5K and photosensitive drum 4K. In the meantime, command/image processor 41 transmits bitmap data per page to LED head interface unit 42.

LED head interface unit 42 lights LEDs of LED head 11K which correspond to the transmitted bitmap data to exposure photosensitive drum 4K charged with −600V with light and thereby neutralizes the exposed part to −50V. Thus, an electrostatic latent image is written on the exposed part of photosensitive drum 4K. By the rotation of photosensitive drum 4K, the electrostatic latent image written on the surface of photosensitive drum 4K reaches a nip area between photosensitive drum 4K and development roller 5K.

Between development roller 5K and photosensitive drum 4K, an electric field directed from photosensitive drum 4K to development roller 5K is formed at the exposed portion neutralized to −50V, and an electric field in an opposite direction, i.e., a direction from development roller 5K to photosensitive drum 4K is formed at an unexposed portion not reduced but still charged with −600V. Thus, part of the negatively-charged toner layer on development roller 5K is selectively attached only to the exposed portion of photosensitive drum 4K, developing the electrostatic latent image as a toner image.

Mechanism controller 43 gives voltage controller 50 commands to generate a primary-transfer voltage, in accordance with the timing at which the recording medium should sequentially reach primary-transfer nip portions of respective primary-transfer rollers 10K, 10Y, 10M, and 10C. Voltage controller 50 reads the set value for the primary-transfer voltage stored in memory 60, and causes primary-transfer voltage generator 54 to supply the primary-transfer voltage to primary-transfer rollers 10K, 10Y, 10M, and 10C. In this embodiment, the primary-transfer voltage is +3000V.

At this event, an electric field directed from transfer roller 10K, 10Y, 10M, or 10C to photosensitive drums 4K, 4Y, 4M, or 4C is formed at the primary-transfer nip portion, and the negatively-charged toner image developed on photosensitive drums 4K, 4Y, 4M, and 4C is primary-transferred to intermediate transfer belt 12. Then, before the toner image primary-transferred to intermediate transfer belt 12 reaches the secondary-transfer nip portion, voltage controller 50 calculates a secondary-transfer voltage (referred to as secondary-transfer voltage Vtr below) supplied by secondary-transfer voltage generator 55 to secondary-transfer roller 23 in the secondary-transferring of the toner image on intermediate transfer belt 12 to the recording medium. Second-transfer voltage Vtr in this embodiment is calculated based on detection results obtained by recording medium type detector 58 and recording medium width detector 59 and a measurement result obtained by secondary-transfer current measurement unit 57. Above all, secondary-transfer roller 23 is known to fluctuate in its electrical characteristics, depending on the atmosphere and environment under which printer 1 is placed and the internal temperature of printer 1.

Voltage controller 50 calculates secondary-transfer voltage Vtr by obtaining the electrical characteristics of secondary-transfer roller 23 by causing secondary-transfer current measurement unit 57 to measure secondary-transfer current flowing through secondary-transfer roller 23 when secondary-transfer voltage generator 55 applies a given secondary-transfer voltage to secondary-transfer roller 23 with at least intermediate transfer belt 12 and secondary-transfer roller 23 driving and no recording medium being present at the secondary-transfer nip portion. In other words, the most recent electrical characteristics of secondary-transfer roller 23 can be obtained by measuring the secondary-transfer current immediately before the toner image primary-transferred to intermediate transfer belt 12 is secondary-transferred to the recording medium. Thus, secondary-transfer voltage Vtr can be accurately calculated.

As described above, in this embodiment, secondary-transfer voltage Vtr is calculated after mechanism controller 43 controls belt motor 46, drum motor 47, and secondary-transfer motor 48 to drive driving roller 13, the rollers of print mechanisms 2K, 2Y, 2M, and 2C, and secondary-transfer roller 23, but before the toner images primary-transferred to intermediate transfer belt 12 reaches the secondary-transfer nip portion. However, the timing of calculating secondary-transfer voltage Vtr is not limited to this, and may be performed at any time before the toner image primary-transferred to intermediate transfer belt 12 is secondary-transferred to the recording medium with at least intermediate transfer belt 12 and secondary-transfer roller 23 driving and no recording medium being present at the secondary-transfer nip portion. Details of the procedure and method of calculating secondary-transfer voltage Vtr are given later.

Next, before the toner image primary-transferred to intermediate transfer belt 12 reaches the secondary-transfer nip portion, mechanism controller 43 drives hopping motor 44 to rotate hopping roller 18, picking up a single sheet from sheet housing cassette 17 and feeding it to an area between pinch roller 19 and registration roller 20. Mechanism controller 43 monitors the output of sheet-feed sensor 22, and stops hopping motor 44 upon detecting that the leading edge of the sheet in the conveyance direction has reached the area between pinch roller 19 and registration roller 20.

Further, mechanism controller 43 drives registration motor 45 in accordance with the timing at which the toner image primary-transferred to intermediate transfer belt 12 should reach the secondary-transfer nip portion, and thereby conveys the sheet between pinch roller 19 and registration roller 20 to guides 21. The sheet is guided by guides 21 and reaches the secondary-transfer nip portion. Simultaneously, mechanism controller 43 gives voltage controller 50 a command to generate a secondary-transfer voltage in accordance with the timing at which the toner image primary-transferred to intermediate transfer belt 12 should reach the secondary-transfer nip portion, and voltage controller 50 causes secondary-transfer voltage generator 55 to supply a secondary-transfer voltage to secondary-transfer roller 23.

In this event, at the secondary-transfer nip portion, an electric field directed from secondary-transfer roller 23 to secondary-transfer opposed roller 24 is formed, and the negatively-charged toner images primary-transferred to intermediate transfer belt 12 are secondary-transferred to the sheet (recording medium). Using secondary-transfer discharge sensor 28, mechanism controller 43 monitors the wrapping of the sheet around secondary-transfer roller 23 or a failure of sheet separation from intermediate transfer belt 12. A sheet for which the transfer steps have been completed is guided by guide 27 and sent to fixation mechanism 29.

Once the sheet reaches the fixation mechanism 29, the sheet is nipped and conveyed by heat roller 30 which has already reached the fixable temperature and pressure roller 31 which applies pressure to heat roller 30, pressing and melting the toner on the sheet. Thereby, the toner images are fixed to the sheet. Using fixation discharge sensor 34, mechanism controller 43 monitors any paper jam at the fixation mechanism 29 and the sheet wrapping around heat roller 30. A sheet for which the fixation step has been completed is guided by guides 36 and is discharged to stacker 35. At the same time that the fixation step is performed, the secondary-transfer residual toner on intermediate transfer belt 12 is scraped off by cleaning blade 25 to waste toner tank 26.

After completing all the steps above, in FIG. 2, mechanism controller 43 stops belt motor 46, drum motor 47, and secondary-transfer motor 48 and, at the same time, gives voltage controller 50 a command to stop causing charge voltage generator 51, supply voltage generator 52, and development voltage generator 53 to supply their bias voltages to the corresponding rollers of the print mechanisms 2K, 2Y, 2M, and 2C. Mechanism controller 43 also stops heater motor 49 and heater 32. Thereby, the print operation is completed. Next, the procedure and method of calculating secondary-transfer voltage Vtr are described.

Figure 4:
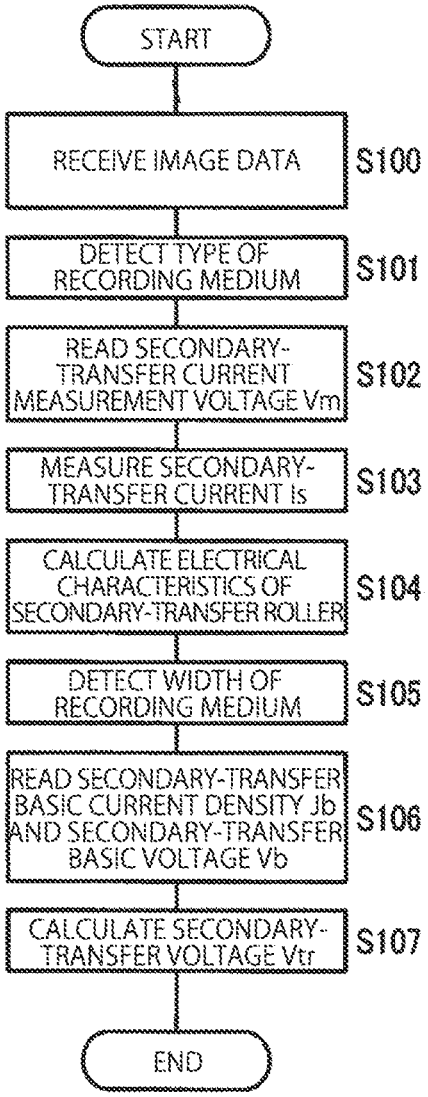
FIG. 4 is a flowchart illustrating a flow of calculating a secondary-transfer voltage in the first embodiment.

A description is given of the processing of the secondary-transfer voltage calculation performed by voltage controller 50, secondary-transfer current measurement unit 57, recording medium type detector 58, and recording medium width detector 59, with reference to FIGS. 1 and 2 and also to FIG. 4 which is a flowchart illustrating steps (indicated by S in FIG. 4) of the secondary-transfer voltage calculation in the first embodiment.

S100: Once host interface unit 40 receives image data sent from the host computer, voltage controller 50 starts calculating secondary-transfer voltage Vtr.

S101: Recording medium type detector 58 reads information indicating the type of the recording medium, from recording medium setting information contained in the print data sent from the host computer. The information on the type of the recording medium in this embodiment indicates the type of the recording medium which is classified according to a resistance value of the recording medium, and includes high-quality paper, plain paper, and overhead projector (OHP) film. The information on the type of the recording medium can be set by a user when the user transmits, to host interface unit 40, image data that he or she wants to print.

Although the types of a recording medium that can be set are high-quality paper, plain paper, and OHP film in this embodiment, the invention is not limited to these, and the types may be changed to heavy paper, recycled paper, or special paper according to necessity. Generally, a recording medium has a volume resistivity (one of the parameters indicating a resistance value of a recording medium) of about $10^8$ Ω·cm to $10^{15}$ Ω·cm. Specifically, high-quality paper has a volume resistivity of $10^9$ Ω·cm or less, plain paper has a volume resistivity of $10^9$ Ω·cm to $10^{11}$ Ω·cm, and OHP film has a volume resistivity of $10^{11}$ Ω·cm or more; they tend to have a relation of high-quality paper<plain paper<OHP film.

S102: Based on the information on the type of the recording medium detected by recording medium type detector 58, voltage controller 50 reads secondary-transfer current measurement voltage Vm stored in memory 60. Second-transfer current measurement voltage Vm in this embodiment is a secondary-transfer voltage applied by secondary-transfer voltage generator 55 to secondary-transfer roller 23 to measure a secondary-transfer current flowing through secondary-transfer roller 23.

FIG. 5 is a data table of secondary-transfer current measurement voltage Vm in the first embodiment. A method of creating data table 63 of secondary-transfer current measurement voltage Vm in the first embodiment illustrated in FIG. 5 is described later.

S103: voltage controller 50 causes secondary-transfer voltage generator 55 to sequentially supply secondary-transfer roller 23 with secondary-transfer current measurement voltages Vm read based on the information on the recording medium type detected by recording medium type detector 58, and gives secondary-transfer current measurement unit 57 a command to sequentially measure secondary-transfer currents Im flowing through secondary-transfer roller 23.

FIG. 6 is a data table of secondary-transfer current Im in the first embodiment. In FIG. 6, secondary-transfer currents Im measured by secondary-transfer current measurement unit 57 are stored in memory 60 as data table 64 of secondary-transfer current Im.

Figure 7:
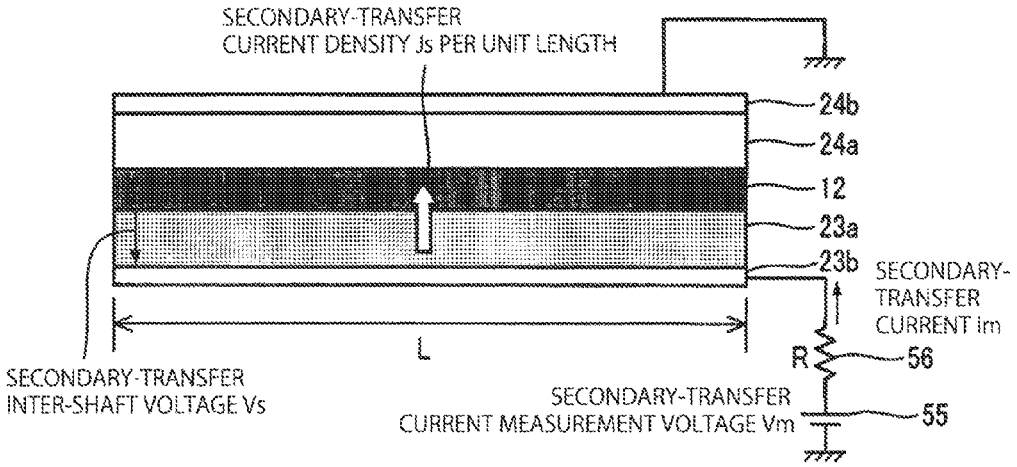
FIG. 7 is a diagram illustrating a secondary-transfer nip portion during measurement of the secondary-transfer current in the first embodiment.

S104: Voltage controller 50 obtains electrical characteristics of secondary-transfer roller 23 from the measurement result in S103. FIG. 7 is a diagram illustrating the secondary-transfer nip portion during the measurement of secondary-transfer current Im in the first embodiment.

The electrical characteristics of secondary-transfer roller 23 in this embodiment are obtained by a linear approximation formula $V=a\times J+b$, using a relation between secondary-transfer current density J per unit length and secondary-transfer inter-shaft voltage V acting across metal shaft 23*b* of secondary-transfer roller 23 and metal shaft 24*b* of secondary-transfer opposed roller 24.

Herein, Vs [V] denotes a secondary-transfer inter-shaft voltage acting across metal shaft 23*b* of secondary-transfer roller 23 and metal shaft 24*b* of secondary-transfer opposed roller 24. The secondary-transfer inter-shaft voltage is measured by applying secondary-transfer current measurement voltage Vm [V], where Jm [μA/mm] denotes a secondary-transfer current density per unit length measured by passing secondary-transfer current Im through secondary-transfer roller 23, R [MΩ] denotes a resistance value of fixed resistance 56, and L [mm] denotes the length of secondary-transfer roller 23 along a direction orthogonal to the conveyance direction of intermediate transfer belt 12. As an example, coefficients a and b of the linear approximation formula are obtained below by the relation between secondary-transfer inter-shaft voltage V and secondary-transfer current density J when the types of recording medium detected by recording medium type detector 58 are "high-quality paper" and "OHP film."

A. When the Type of Recording Medium is "High-Quality Paper"

Second-transfer inter-shaft voltage Vs [V] is $Vs1=Vm1-Im1\times R$ and $Vs2=Vm2-Im2\times R$, secondary-transfer current density Jm [μA/mm] is Jm1=Im1/L and Jm2=Im2/L, and coefficients a and b of the linear approximation formula to be obtained are a=(Vs2−Vs1)/(Jm2−Jm1) and b=(Vs1×Jm2−Vs2×Jm1)/(Jm2−Jm1).

B. When the Type of Recording Medium is "OHP film"

Second-transfer inter-shaft voltage Vs [V] is Vs1=Vm1×Im1×R, Vs4=Vm4−Im4×R, and Vs5=Vm5−Im5×R, secondary-transfer current density Jm [μA/mm] is Jm1=Im1/L, Jm4=Im4/L, Jm5=Im5/L, and coefficients a and b of the linear approximation formula to be obtained are a1 and b1 where a1=(Vs4−Vs1)/(Jm4−Jm1) and b1=(Vs1×Jm4−Vs4×Jm1)/(Jm4−Jm1) when V≤Vs4 (J≤Jm4), and are a2 and b2 where a2=(Vs5−Vs4)/(Jm5−Jm4) and b2=(Vs4×Jm5−Vs5×Jm4)/(Jm5−Jm4) when V>Vs4 (J>Jm4).

S105: Recording medium width detector 59 reads information on the width of the recording medium from the recording medium setting information contained in the print data sent from the host computer. The information on the width of the recording medium in this embodiment indicates the width of the recording medium measured in the direction orthogonal to the conveyance direction of intermediate transfer belt 12, and includes A3 size (297 mm), A4 size (210 mm), and A5 size (148 mm) herein. However, the invention is not limited to these widths, and the widths may be changed to other A sizes or B sizes according to necessity.

S106: Based on the type of recording medium detected by recording medium type detector 58, voltage controller 50 reads secondary-transfer basic current density Jb stored in memory 60.

FIG. 8 is a data table illustrating relations between secondary-transfer basic current densities Jb and secondary-transfer basic voltages to be applied to achieve corresponding secondary-transfer basic current densities Jb, in the first embodiment. In FIG. 8, secondary-transfer basic current density Jb is a density of secondary-transfer current flowing through an inside of the medium region, the density being necessary for achieving a favorable secondary transfer for its corresponding type of recording medium, and secondary-transfer basic voltage Vb is a secondary-transfer voltage acting on the recording medium when that current flows. The inside of the medium region in this embodiment refers to a region where secondary-transfer roller 23 and secondary-transfer opposed roller 24 are in contact with each other with intermediate transfer belt 12 and the recording medium in-between. An outside of medium region refers a region where secondary-transfer roller 23 and secondary-transfer opposed roller 24 are in contact with each other with only intermediate transfer belt 12 in-between.

The values in data table 65 in FIG. 8 are obtained by experiment. FIG. 8 illustrates the relations between secondary-transfer basic current densities Jb and secondary-transfer basic voltages Vb to be applied to achieve corresponding secondary-transfer basic current densities Jb. Second-transfer basic current density Jb is the density of secondary-transfer current flowing through the inside of the medium region, the density being necessary for achieving a favorable secondary transfer for its corresponding type of recording medium, and secondary-transfer basic voltages Vb is a secondary-transfer voltage acting on the recording medium when that current flows. Generally, the density of secondary-transfer current necessary for secondary-transferring toner images on intermediate transfer belt 12 to a recording medium does not depend on a resistance value of the recording medium, and a large difference is not observed among different types of recording media. The secondary-transfer voltage acting on the recording medium, on the other hand, tends to increase as the resistance value of the recording medium increases.

Figure 9:
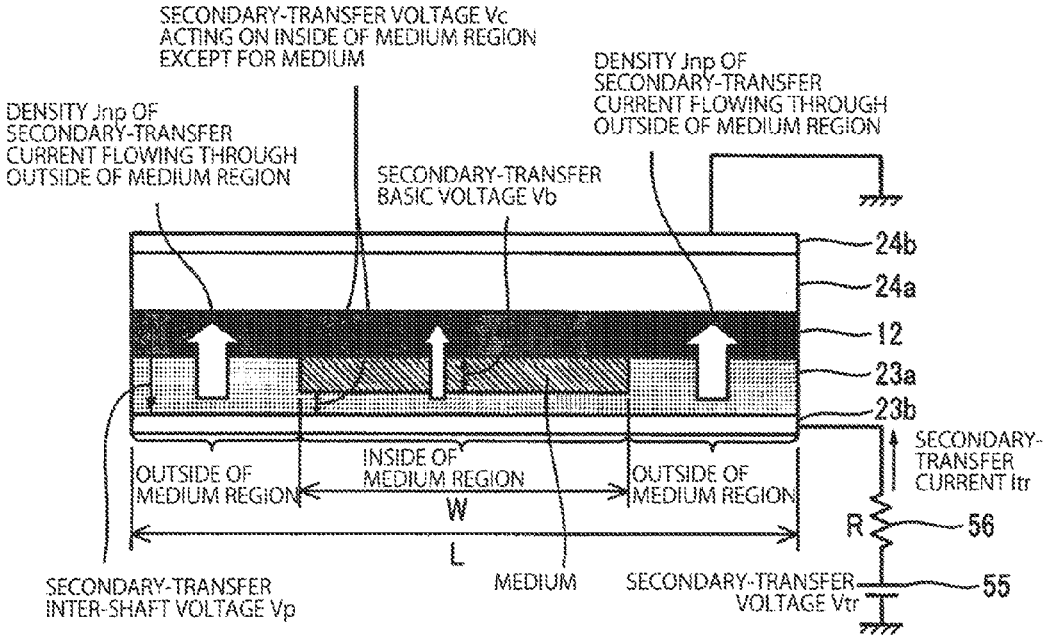
FIG. 9 is a diagram illustrating the secondary-transfer nip portion during secondary-transfer.

S107: Voltage controller 50 calculates secondary-transfer voltage Vtr based on the electrical characteristics of secondary-transfer roller 23 obtained in S104, the width of recording medium detected in S105, and secondary-transfer basic current density Jb and secondary-transfer basic voltage Vb that are read in S106. With that, this processing ends. FIG. 9 is a diagram illustrating the secondary-transfer nip portion during the secondary transfer in the first embodiment. As an example, a description is given, with reference to FIG. 9, of how to obtain secondary-transfer voltage Vtr for cases where the type of recording medium detected by recording medium type detector 58 is "high-quality paper" and "OHP film."

A. When the Type of Recording Medium is "High-Quality Paper"

First, secondary-transfer voltage Vc [V] acting on the inside of the medium region, except for the recording medium when the current density in the recording medium is secondary-transfer basic current density Jb1, is obtained from the electrical characteristics of secondary-transfer roller 23 obtained in S104, according to a formula Vc=a×Jb1+b.

Second-transfer inter-shaft voltage Vp [V] acting across metal shaft 23*b* of secondary-transfer roller 23 and metal shaft 24*b* of secondary-transfer opposed roller 24, with the recording medium being present at the secondary-transfer nip portion, is Vp=Vb1+Vc. As the density of current flowing through the outside of the medium region, secondary-transfer current density Jnp [μA/mm] is obtained from the electrical characteristics of secondary-transfer roller 23 obtained in S104, according to the formula Jnp=(Vp−b)/a.

Second-transfer current Itr [μA] flowing through secondary-transfer roller 23, which is necessary for achieving a favorable secondary-transfer, is the total of the secondary-transfer current flowing through the inside of the medium region and the secondary-transfer current flowing through the outside of the medium region; therefore, Itr=Jb1×W+Jnp×(L−W) where W [mm] denotes the width of the recording medium. Second-transfer voltage Vr [V] acting on fixed resistance 56 when secondary-transfer current Itr [μA] flows through secondary-transfer roller 23 is Vr=Itr×R. Second-transfer voltage Vtr [V], which is supplied by secondary-transfer voltage generator 55 and is necessary to pass secondary-transfer current Itr through secondary-transfer roller 23, is the total of secondary-transfer inter-shaft voltage Vp and secondary-transfer voltage Vr [V] acting on fixed resistance 56, and is therefore Vtr=Vp+Vr.

Figure 10:
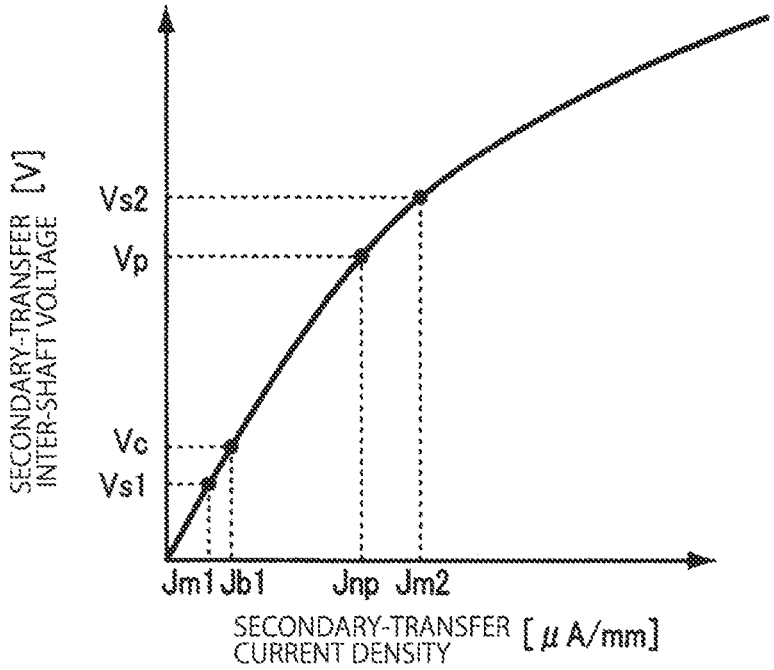
FIG. 10 is a diagram illustrating the dependency of the secondary-transfer current density on a secondary-transfer inter-shaft voltage in the first embodiment (high-quality paper).

FIG. 10 is a diagram illustrating the dependency of the secondary-transfer current density on the secondary-transfer inter-shaft voltage in the first embodiment (high-quality paper). In FIG. 10, the electrical characteristics of secondary-transfer roller 23 obtained in S104 are used to obtain secondary-transfer voltage Vc acting on the inside of the medium region except for the recording medium when the density of current flowing through the recording medium is secondary-transfer basic current density Jb1, as well as secondary-transfer current density Jnp of current flowing through the outside of the medium region when the secondary-transfer inter-shaft voltage is Vp. Second-transfer voltage Vc and secondary-transfer current density Jnp are used in calculating secondary-transfer voltage Vtr.

In order to obtain accurate secondary-transfer voltage Vc and secondary-transfer current density Jnp, the measurement range of the electrical characteristics of secondary-transfer roller 23 obtained in S104 has to include at least secondary-transfer voltage Vc and secondary-transfer current density Jnp. Hence, in this embodiment, data table 63 of secondary-transfer current measurement voltage Vm is created so that Vc<Vs1 and Jnp<Jm2 hold true.

B. When the Recording Medium Type is "OHP Film"

First, secondary-transfer voltage Vc [V] acting on the inside of the medium region, except for the recording medium when the secondary-transfer basic current density of current flowing through the recording medium is Jb3, is obtained from the electrical characteristics of secondary-transfer roller 23 obtained in S104, according to a formula Vc=a1×Jb3+b1.

Second-transfer inter-shaft voltage Vp [V], acting across metal shaft 23*b* of secondary-transfer roller 23 and metal shaft 24*b* of secondary-transfer opposed roller 24 with the recording medium being present at the secondary-transfer nip portion, is Vp=Vb3+Vc. As the density of the secondary-transfer current flowing through the outside of the medium region, secondary-transfer current density Jnp [μA/mm] is obtained from the electric characteristics of secondary-transfer roller 23 obtained in S104, according to a formula Jnp=(Vp−b2)/a2.

Second-transfer current Itr [μA] flowing through secondary-transfer roller 23, which is necessary for achieving a favorable secondary-transfer, is the total of the secondary-transfer current flowing through the inside of the medium region and the secondary-transfer current flowing through the outside of medium region; therefore, Itr=Jb3×W+Jnp×(L−W) where W [mm] denotes the width of the recording medium. Second-transfer voltage Vr [V] acting on fixed resistance 56 when secondary-transfer current Itr [μA] flows through secondary-transfer roller 23 is Vr=Itr×R. Second-transfer voltage Vtr [V], which is supplied by secondary-transfer voltage generator 55 and is necessary to pass secondary-transfer current Itr through secondary-transfer roller 23, is the total of secondary-transfer inter-shaft voltage Vp and secondary-transfer voltage Vr [V] acting on fixed resistance 56, and is therefore Vtr=Vp+Vr.

Figure 11:
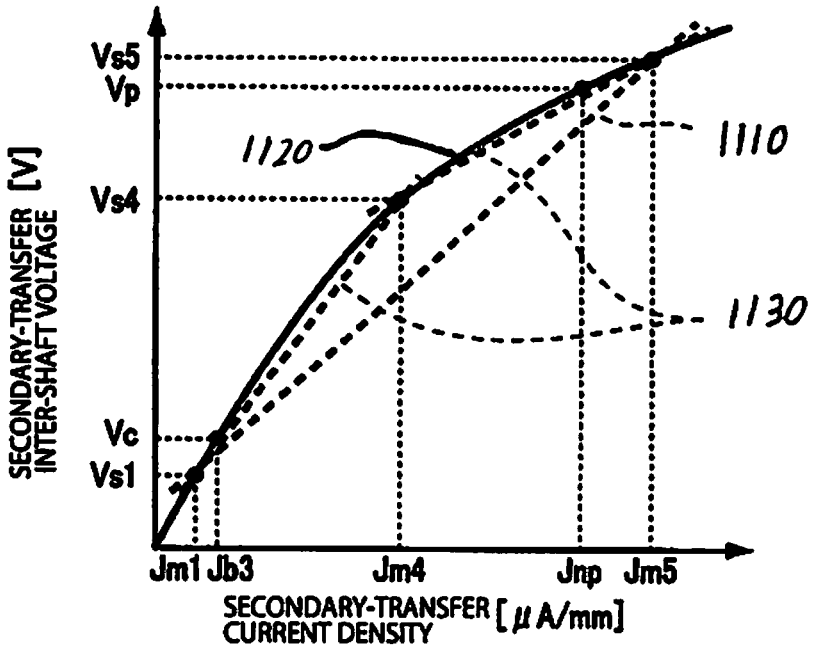
FIG. 11 is a diagram illustrating the dependency of the secondary-transfer current density on a secondary-transfer inter-shaft voltage in the first embodiment (OHP film).

FIG. 11 is a diagram illustrating the dependency of the secondary-transfer current density on the secondary-transfer inter-shaft voltage in the first embodiment (OHP film). In FIG. 11, as is the case for the high-quality paper, the electrical characteristics of secondary-transfer roller 23 obtained in S104 are used to obtain secondary-transfer voltage Vc acting on the inside of the medium region. This is except for the recording medium when the density of the current flowing through the recording medium is secondary-transfer basic current density Jb3, as well as secondary-transfer current density Jnp of the current flowing through the outside of the medium region when the secondary-transfer inter-shaft voltage is Vp. Second-transfer voltage Vc and secondary-transfer current density Jnp are used in calculating secondary-transfer voltage Vtr.

Since secondary-transfer basic voltage Vb3 for the recording medium type "OHP film" is higher than secondary-transfer basic voltage Vb1 for the recording medium type "high-quality paper," secondary-transfer inter-shaft voltage Vp for the recording medium type "OHP film" tends to be higher than that for the recording medium type "high-quality paper." In other words, the electrical characteristics of secondary-transfer roller 23 of a wider range are needed for the secondary-transfer inter-shaft voltage and the secondary-transfer current density.

In order to obtain accurate secondary-transfer voltage Vc and secondary-transfer current density Jnp, the measurement range of the electrical characteristics of secondary-transfer roller 23 obtained in S104 has to include at least secondary-transfer voltage Vc and secondary-transfer current density Jnp. However, the electrical characteristics of secondary-transfer roller 23 are generally non-linear, that is, not linear. Thus, when data table 63 of secondary-transfer current measurement voltage Vm is created using two values, as shown by the dashed line plot 1110 in FIG. 11, a linear approximation formula obtained from the electrical characteristics of secondary-transfer roller 23 obtained in S104 greatly differs from the actual electrical characteristics of secondary-transfer roller 23, whereby the actual electrical characteristics of secondary-transfer roller 23 is shown by the non-dashed line plot 1120 in FIG. 11. FIG. 11 also shows a dashed line plot 1130 using a linear approximation formula with three values of secondary-transfer current measurement voltage Vm, which more closely matches the actual electrical characteristics of secondary-transfer roller 23 (as seen by the non-dashed line plot 1120 in FIG. 11).

In this embodiment, for the recording medium type "OHP film" needing the electrical characteristics of secondary-transfer roller 23 of a wider range, data table 63 of secondary-transfer current measurement voltage Vm is created using three values so that Vc<Vs1 and Jm4<Jnp<Jm5 hold true. Thus, secondary-transfer voltage Vc and secondary-transfer current density Jnp obtained are more accurate than those obtained with two values. In this embodiment, data table 63 of secondary-transfer current measurement voltage Vm is created with two or more values, depending on the recording medium type. However, the invention is not limited to this, and a change may be made according to necessity.

As an example, secondary-transfer voltage Vtr for each type of recording medium, "high-quality paper," "plain paper," and "OHP film" and for each recording medium width of A3 size (297 mm), A4 size (210 mm), and A5 size (148 mm) is calculated with an actual numerical value. Note that length L of secondary-transfer roller 23 measured in the direction orthogonal to the conveyance direction of intermediate transfer belt 12 is 320 [mm], and resistance value R of fixed resistance 56 is 20 [MΩ]. FIG. 12 is a data table of secondary-transfer current measurement voltages in the first embodiment (an example using numerical values), and FIG. 13 is a data table of secondary-transfer currents in the first embodiment (an example also using numerical values).

FIG. 13 illustrates secondary-transfer currents measured using secondary-transfer current measurement voltages illustrated in FIG. 12. FIG. 14 is a data table illustrating relations between secondary-transfer basic current densities and secondary-transfer basic voltages to be applied to achieve the corresponding densities (an example using numeric values). An optimum, experimentally-known value of secondary-transfer basic current density Jb is stored in memory 60 for each type of recording medium, as illustrated in FIG. 14.

FIG. 15 is a data table illustrating secondary-transfer voltage Vtr calculated by the image formation apparatus for each width of recording medium in the first embodiment (an example using numeric values). In FIG. 15, using "plain paper" as a reference among the recording medium types "high-quality paper," "plain paper," and "OHP film," "high-quality paper" of a low resistance value tends to have a low secondary-transfer voltage Vtr, and "OHP film" of a high resistance value tends to have a high secondary-transfer voltage Vtr.

Further, using A4 size (210 mm) as a reference, A3 size (297 mm) of a large width tends to have a low secondary-transfer voltage Vtr, and A5 size (148 mm) of a small width tends to have high secondary-transfer voltage Vtr. As can be seen from the above results, as the resistance value of a recording medium increases, secondary-transfer voltage Vtr changes greatly depending on the width of the recording medium. This is because, as described earlier, transfer current highly depends on the width of the recording medium.

When the direct transfer method and the intermediate transfer method are compared, the resistance value of a secondary transfer unit of the intermediate transfer method is lower than that of a transfer unit of the direct transfer method. For this reason, the intermediate transfer method requires the measure described in this embodiment. Unlike the transfer unit of the direct transfer method, the secondary transfer unit of the intermediate transfer method has no insulator such as a photosensitive body, but is configured with a secondary-transfer roller, an intermediate transfer belt, and a conductor having the resistance of a secondary-transfer opposed roller (metal roller) (the secondary-transfer opposed roller is excluded because it is metallic). The widths of at least the secondary-transfer roller, the intermediate transfer belt, and the secondary-transfer opposed roller in the direction orthogonal to the conveyance direction of the intermediate transfer belt constituting the secondary transfer unit, are equal to or more than the maximum width of the recording medium, which can be handled by the image formation apparatus, measured in the direction orthogonal to the conveyance direction of the intermediate transfer belt.

For this reason, the secondary transfer unit has the inside and the outside of the medium region, and the inside of the medium region has a resistance value higher than that of the outside of the medium region because of the existence of the recording medium. Hence, when a transfer voltage is applied to transfer toner images to the recording medium, transfer current flows more through the outside of the medium region having a low resistance value than through the inside of the medium region. In other words, the smaller the width of a recording medium is, the larger the area of the outside of the medium region is, the outside of the medium region having a lower resistance value than the inside of the medium region does. Thus, more transfer current flows through the outside of the medium region.

Hence, this embodiment copes with the problem of the increase in the dependency of the transfer current on the width of a recording medium. This increase is caused because (A) in a case where toner images are transferred to a recording medium having a high resistance value, compared to the case where the toner images are transferred to a recording medium having a low resistance, the difference in the resistance value between the inside of the medium region and the outside of the medium region is large and therefore more transfer current is likely to flow through the outside of the medium region and (B) a favorable transfer of toner images to a recording medium requires a high transfer voltage.

As described, in this embodiment, secondary-transfer current flowing across the shafts of secondary-transfer roller 23 and secondary-transfer opposed roller 24 is measured at least twice while changing the secondary-transfer current measurement voltage. Then, based on the measurement results, the current density in a recording medium is calculated while taking the width of the recording medium into consideration. Thus, the secondary-transfer voltage generator can generate a secondary-transfer voltage for achieving a known, optimum current density in the recording medium, allowing a favorable print quality to be obtained without being dependent on the installed environment and the internal temperature of printer 1 and the type and width of the recording medium.

As described thus far, the first embodiment offers the following advantageous effects. Specifically, in a case where toner images are to be transferred to a recording medium having a high resistance in an image formation apparatus employing the intermediate transfer method, secondary-transfer voltage is controlled so that a favorable print quality can be obtained without being dependent on the width of the recording medium. Although the latent image formation unit is an LED head in this embodiment, it may be a laser light source or the like, and the invention is not limited to this embodiment. In addition, although the number of print mechanisms is four in this embodiment, the number or the arrangement order of the print mechanisms are not limitative. The invention is applicable not only to an apparatus having multiple print mechanisms, but also to an apparatus having a single print mechanism for one color, e.g., black.

Embodiment 2

Figure 16:
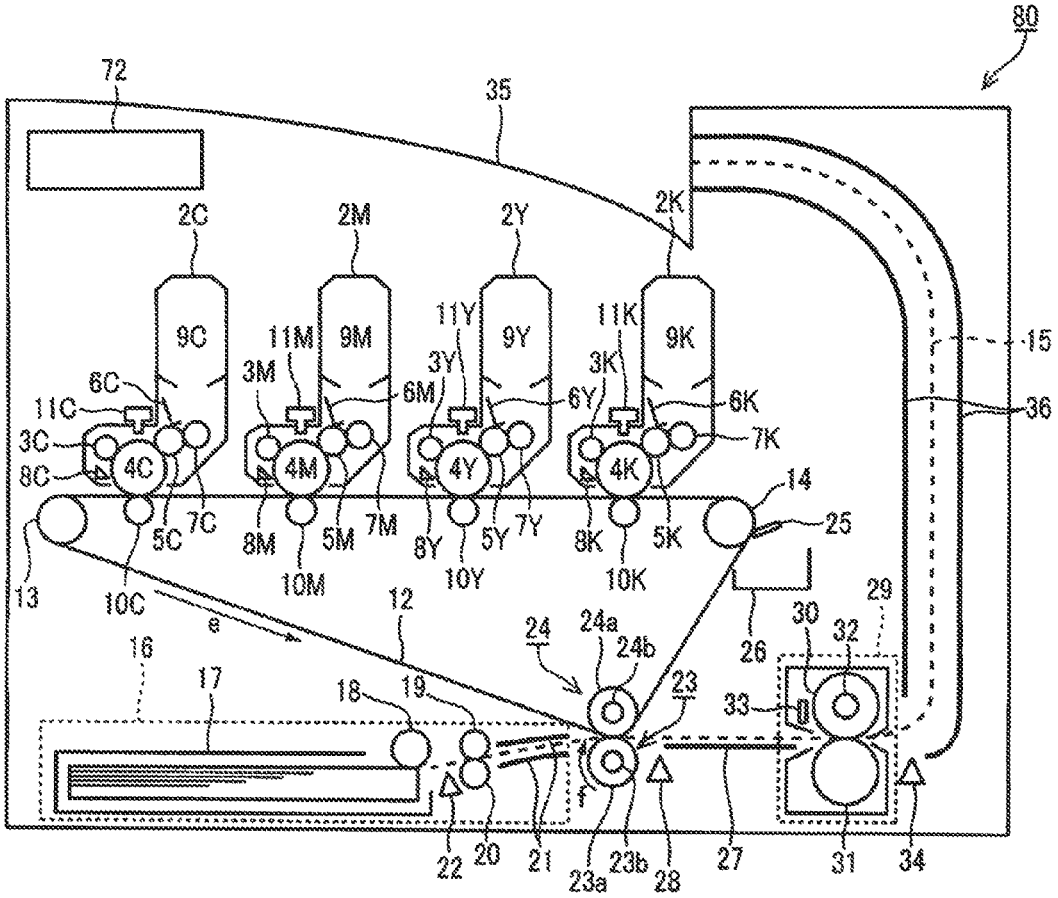
FIG. 16 is a diagram illustrating the schematic configuration of an image formation apparatus in a second embodiment.

FIG. 16 is a diagram illustrating the schematic configuration of an image formation apparatus of a second embodiment of the invention. Note that parts which are the same as those in the first embodiment are given the same reference numerals as the first embodiment, and are not described again here. The second embodiment is different from the first embodiment in that printer 1 is modified into printer 80 by newly adding operation panel 72. Operation panel 72 displays an error when a recording medium type which is set by a user and contained in image data sent from a host computer does not match the actual type of a recording medium housed in sheet-housing cassette 17 of printer 80.

Figure 17:
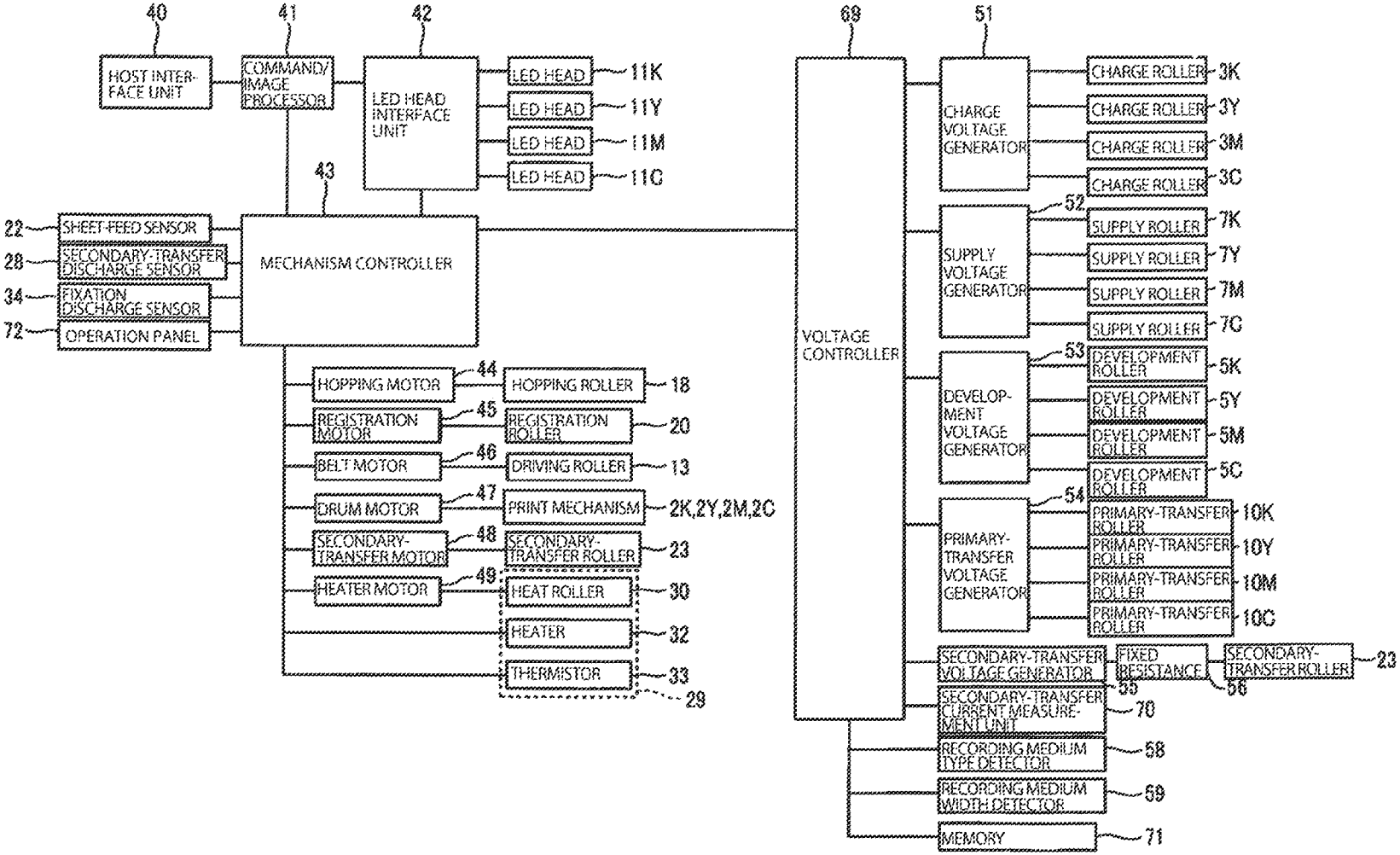
FIG. 17 is a block diagram of a control circuit of the image formation apparatus in the second embodiment.

FIG. 17 is a block diagram of a control circuit of the image formation apparatus of the second embodiment. Note that parts which are the same as those in the first embodiment are given the same reference numerals as in the first embodiment, and are not described again here. The control circuit of the second embodiment is different from that of the first embodiment in that voltage controller 50, secondary transfer current measurement unit 57, and memory 60 are changed to voltage controller 69, secondary-transfer current measurement unit 70, and memory 71, respectively. Voltage controller 69, secondary-transfer current measurement unit 70, and memory 71 have the same configurations as voltage controller 50, secondary transfer current measurement unit 57, and memory 60 of the first embodiment.

Figure 18:
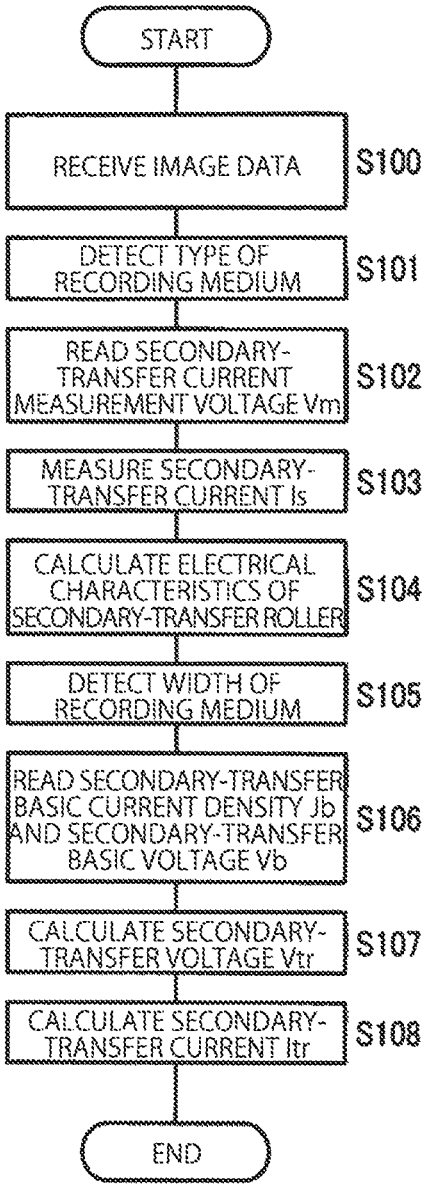
FIG. 18 is a flowchart illustrating a flow of calculating a secondary-transfer voltage in the second embodiment.

Operation of printer 80 having the above configuration is described. Calculation of secondary-transfer voltage Vtr and operation of the secondary transfer of printer 80 of this embodiment are different from those in the first embodiment. Operation which is the same as that of the first embodiment 1 is not described here. FIG. 18 is a flowchart illustrating a flow of the secondary-transfer voltage calculation in the second embodiment. Steps S101 to S107 in FIG. 18 are the same as those illustrated in FIG. 4 in the first embodiment, and are therefore not descried again here.

S108: Voltage controller 69 stores, in memory 71, secondary-transfer current Itr which flows through secondary-transfer roller 23 and is necessary for achieving a favorable secondary transfer. Second-transfer current Itr is obtained in the process of calculating secondary-transfer voltage Vtr. With that, the processing ends. Mechanism controller 43 gives voltage controller 69 a command to generate a secondary-transfer voltage in accordance with the timing at which toner images primary-transferred to intermediate transfer belt 12 should reach the secondary-transfer nip portion, and thus voltage controller 69 causes secondary-transfer voltage generator 55 to supply the secondary-transfer voltage to secondary-transfer roller 23.

At the same time, voltage controller 69 compares secondary-transfer current Itr2, which flows through secondary-transfer roller 23 and is measured by secondary-transfer current measurement unit 70 during the secondary transfer, with secondary-transfer current Itr stored in memory 71 in S108 of the flowchart illustrating the flow of calculating secondary-transfer voltage Vtr. Thereby, voltage controller 69 determines whether or not a recording medium type, which is set by a user and contained in image data sent from a host computer, matches the actual type of a recording medium housed in sheet-housing cassette 17 of printer 80.

In this embodiment, voltage controller 69 determines that a recording medium type, which is set by a user and contained in print data sent from a host computer, does not match the actual type of a recording medium housed in sheet-housing cassette 17 of printer 80, if the difference between secondary-transfer current Itr2 and secondary-transfer current Itr is 10% or more. In this embodiment, if the difference between secondary-transfer current Itr2 and secondary-transfer current Itr is 10% or less, secondary-transfer basic current Jb and secondary-transfer basic voltage Vb for achieving a favorable secondary transfer are determined. However, the invention is not limited to this, and a change may be made according to necessity.

If voltage controller 69 determines that the recording medium type, which is set by a user and is contained in the image data sent from the host computer, does not match the actual type of the recording medium housed in sheet-housing cassette 17 of printer 80, mechanism controller 43, after completion of the print operation, displays on operation panel 72 an error indicating that the recording medium type, which is set by the user and contained in the image data sent from the host computer, does not match the actual type of the recording medium housed in sheet-housing cassette 17 of printer 80.

As described above, in the second embodiment, a user can be notified when the recording medium type, which is set by the user and contained in the image data sent from the host computer, does not match the actual type of the recording medium housed in sheet-housing cassette 17 of printer 80, which is one of the reasons of imaging failure during the secondary transfer. In addition, values in the data tables of the secondary-transfer current measurement voltages and the secondary-transfer basic current densities stored in memory and set for each recording medium type are not picked for a wrong recording medium type. Thus, print quality can be improved.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations, including the meaning(s) and range(s) within equivalent arrangements of the claims, are intended to be embraced in the invention.

What is claimed is:

1. An image formation apparatus comprising:

a primary transfer unit configured to transfer a developer image formed on an image carrier to an intermediate transfer body;

a secondary transfer unit configured to transfer the developer image transferred to the intermediate transfer body to a recording medium;

a voltage application unit configured to apply a voltage to the secondary transfer unit;

a voltage controller configured to control the voltage to be applied to the secondary transfer unit by the voltage application unit;

a recording medium type detector configured to detect a type of the recording medium; and a recording medium width detector configured to detect a width of the recording medium in a direction orthogonal to a conveyance direction of the intermediate transfer body, wherein the voltage controller controls the voltage to be applied to the secondary transfer unit, based on the type of the recording medium detected by the recording medium type detector and the width of the recording medium detected by the recording medium width detector, wherein the voltage controller includes a current measurement unit configured to measure current flowing through the secondary transfer unit when the voltage application unit applies a voltage thereto with the recording medium not present at the secondary transfer unit, based on a detection result obtained by the recording medium type detector, the voltage controller controls the voltage that the voltage application unit applies to the secondary transfer unit when the current measurement unit is to measure the current flowing through the secondary transfer unit, and a density of current flowing through the recording medium is adjusted to a value suitable for the type of the recording medium by the voltage controller controlling the voltage applied to the secondary transfer unit based on a calculated value of a density of current flowing through the recording medium, the calculated value being calculated from a result of the measurement on the current flowing through the secondary transfer unit and the width of the recording medium detected by the recording medium width detector.

2. The image formation apparatus according to claim 1, wherein the current measurement unit measures the current flowing through the secondary transfer unit after the primary transfer unit transfers the developer image to the intermediate transfer body but before the secondary transfer unit transfers the developer image to the recording medium.

3. An image formation apparatus comprising:

a primary transfer unit configured to transfer a developer image formed on an image carrier to an intermediate transfer body;

a secondary transfer unit configured to transfer the developer image transferred to the intermediate transfer body to a recording medium;

a current generator configured to pass current through the secondary transfer unit, a current controller configured to control the current passed by the current generator through the secondary transfer unit, a recording medium type detector configured to detect a type of the recording medium; and a recording medium width detector configured to detect a width of the recording medium in a direction orthogonal to a conveyance direction of the intermediate transfer body, wherein the current controller controls the current passed through the secondary transfer unit, based on the type of the recording medium detected by the recording medium type detector and the width of the recording medium detected by the recording medium width detector, wherein the current controller includes a current measurement unit configured to measure current flowing through the secondary transfer unit when the current generator passes current through the secondary transfer unit, based on a detection result obtained by the recording medium type detector, the current controller controls the current passed by the current generator through the secondary transfer unit when the current measurement unit is to measure the current flowing through the secondary transfer unit, and a density of current flowing through the recording medium is adjusted to a value suitable for the type of the recording medium by the current controller controlling the current passed by the current generator through the secondary transfer unit based on a calculated value of a density of current flowing through the recording medium, the calculated value being calculated from a result of the measurement on the current flowing through the secondary transfer unit and the width of the recording medium detected by the recording medium width detector.

4. The image formation apparatus according to claim 1, wherein the apparatus further comprises a recording medium housing unit configured to house the recording medium to which the developer image is to be transferred, and when a type of the recording medium housed in the recording medium housing unit does not match the type of the recording medium detected by the recording medium type detector, the voltage controller causes a display unit to display an indication that the types of the recording media do not match.

5. The image formation apparatus according to claim 1, wherein the type of the recording medium is a type classified according to a resistance value of the recording medium.

6. The image formation apparatus according to claim 3, wherein the current measurement unit measures the current flowing through the secondary transfer unit after the primary transfer unit transfers the developer image to the intermediate transfer body but before the secondary transfer unit transfers the developer image to the recording medium.

7. The image formation apparatus according to claim 3, wherein the apparatus further comprises a recording medium housing unit configured to house the recording medium to which the developer image is to be transferred, and when a type of the recording medium housed in the recording medium housing unit does not match the type of the recording medium detected by the recording medium type detector, the voltage controller causes a display unit to display an indication that the types of the recording media do not match.

8. The image formation apparatus according to claim 3, wherein the type of the recording medium is a type classified according to a resistance value of the recording medium.

9. The image formation apparatus according to claim 1, wherein the intermediate transfer body comprises an endless belt.

10. The image formation apparatus according to claim 3, wherein the intermediate transfer body comprises an endless belt.

* * * * *